US005186342A

United States Patent [19]

Shimizu

[11] Patent Number: 5,186,342

[45] Date of Patent: Feb. 16, 1993

[54] INTEGRATED PASSIVE SWAY ARREST SYSTEM FOR CARGO CONTAINER HANDLING CRANES

[75] Inventor: Yuso Shimizu, San Mateo, Calif.

[73] Assignee: Paceco Corp., San Mateo, Calif.

[21] Appl. No.: 845,350

[22] Filed: Mar. 4, 1992

Related U.S. Application Data

[63] Continuation of Ser. No. 610,421, Nov. 7, 1990, abandoned.

[51] Int. Cl.[5] ..... B66C 13/08

[52] U.S. Cl. ..... 212/147

[58] Field of Search ..... 212/146, 147, 148, 149, 212/156, 205, 214; 414/137.1, 138.2, 138.4, 140.3, 141.7, 142.8

[56] References Cited

U.S. PATENT DOCUMENTS

| | | | |
|---|---|---|---|
| 3,375,938 | 4/1968 | Crittenden . | |
| 3,532,324 | 10/1970 | Crittenden . | |
| 3,739,922 | 6/1973 | Hasegawa . | |
| 3,825,128 | 7/1974 | Cooper . | |
| 3,899,083 | 8/1975 | Flessner et al. | 212/147 |
| 3,900,114 | 8/1975 | Inoue et al. | 212/147 |
| 3,945,503 | 3/1976 | Cooper . | |
| 3,945,504 | 3/1976 | Wright . | |
| 4,842,150 | 6/1989 | Potoenjak | 212/147 |

FOREIGN PATENT DOCUMENTS

| | | | |
|---|---|---|---|
| 91258 | 8/1978 | Japan | 212/147 |
| 24786 | 5/1982 | Japan | 212/147 |
| 1542821 | 3/1979 | United Kingdom | 212/147 |

*Primary Examiner*—Joseph F. Peters, Jr.
*Assistant Examiner*—Stephen P. Avila
*Attorney, Agent, or Firm*—Bruce & McCoy

[57] ABSTRACT

A passive sway arrest system for dockside cargo container handling cranes which includes mounting on the load-carrying trolley a pivotable platform which oscillates when a load being carried by the trolley sways with pendulum motion when the trolley is moved along the boom and girder of the crane, the oscillation of the platform providing a means to arrest sway.

2 Claims, 3 Drawing Sheets

INTEGRATED PASSIVE SWAY ARREST SYSTEM FOR CARGO CONTAINER HANDLING CRANES

This is a continuation of copending application(s) Ser. No. 07/610,421 filed on Nov. 7, 1990 now abandoned.

BACKGROUND OF THE INVENTION

1. FIELD OF THE INVENTION

The present invention relates to passive sway arrest systems for cargo container transporting cranes, and more particularly, to an integrated passive sway arrest system for dockside cargo container handling cranes having a trolley which moves a suspended cargo container lifting spreader fore and aft on a girder and extended boom and which utilizes the wire rope and the sheave system which supports the load beneath the trolley to arrest sway in the suspended moving load.

2. DESCRIPTION OF THE PRIOR ART

Prior to the present invention, many systems have been devised and utilized for the purpose of arresting load sway for cargo container handling cranes. Some of those are disclosed in patents owned by the assignee of the present invention. They include U.S. patent application Ser. Nos.: 3,375,938; 3,532,324; 3,739,922; 3,825,128; 3,945,503; and 3,945,504.

One problem With some of these designs is that the wire ropes act like a spring when there is an appreciable length of rope reeved out and supporting the load, and a means of solving this problem was to install an energy absorber, such as a hydraulic cylinder, at the ends of the ropes in the reeving system to stop the spring action.

Sway arrest systems are of essentially two types: active and passive. An active system usually is defined as requiring some affirmative action to be taken to counteract the induced sway. To take such action, the sway must be sensed by some means whereby an appropriate selected counterforce can be actuated and applied. A passive sway arrest system can be in either an operative or inactive condition, but the passive system does not need to sense the sway: the system just needs to inherently react to sway when the system is in the operative condition.

A problem in arresting sway of a load is in being able to detect the sway at the ends of long suspension ropes if the need is to apply counteracting forces. However, a fairly unique system was developed for the purpose of attempting to detect sway and to arrest it, but it was unsuccessful. This prior art method was to suspend the wire rope reeving which supports the load from a sheave support platform which is pivoted to allow the platform to oscillate in partial rotation as the load swayed. Any rotational movement of the platform on its pivot axis could be sensed to determine when arresting forces should be applied. However, this did not work because when arresting forces were applied to straight hanging wire rope to dampen the oscillation of the platform, the load simply swung with the ropes remaining in a parallelogram. Thus, the system did not identify sway as an isolated movement because the load could swing independently of the rotatable platform, and the system was not able to arrest the sway that it did detect.

The arrangement of a partially rotatable sheave support platform does provide a means by which accurate sway detection can be accomplished when it is modified to allow loads to be applied to the suspension ropes of the sway arrest system which do counteract the sway, and the present invention accomplishes this result. However, the modifications of the prior art by the present invention create a very effective passive sway arrest system in addition to allowing accurate sensing of sway.

SUMMARY OF THE INVENTION

The present invention is a passive sway arrest system for dockside cargo container handling cranes having a load carrying trolley which moves fore and aft on the trolley girder and extended boom of the crane with a cargo container lifting spreader suspended beneath the trolley by wire rope reeving. The system comprises a pivotable or partially rotatable platform mounted on the trolley for supporting the wire rope sheaves through which the wire rope reeving is reeved to support the suspended load. The rotatable sheave support platform is mounted to the trolley with a journaled relation having an axis of rotation which is disposed horizontal to the ground and perpendicular to the fore and aft direction of motion of the trolley along the boom and girder of the crane. Sheaves are mounted on a headblock which is secured to the lifting spreader to support the load which is picked up by the lifting spreader by the wire rope reeving depending from the trolley. The sheaves are mounted at positions on the sheave platform and on the headblock whereby the suspended load is supported by wire ropes whose lifting forces act on the load proximate to the corners of the lifting spreader and proximate to the effective corners of the fore and aft ends of the platform. The wire ropes of the reeving are cross-reeved in the fore and aft direction along the boom to opposite corners of the platform and the load. This cross-reeving occurs at both ends of the spreader.

Passive sway arrest of the load is accomplished in two ways: by inhibiting oscillation of the sheave platform on its journaled mount by providing a dampening means to stop the platform movement; and further by applying a brake to the rotational motion of the shaft which supports the sheave platform in its journaled relation.

OBJECTS OF THE INVENTION

It is therefore an important object of the present invention to provide a new and novel passive sway arrest system for cargo container handling cranes.

It is another object of the present invention to provide a new and novel sway arrest system for cargo container handling cranes which integrates two passive systems which coordinate to abate large and small amplitude sway in the load.

It is a further object of the present invention to provide a new and novel passive sway arrest system for dockside cargo container handling cranes which utilize a trolley that moves along a boom and girder to transport a suspended load.

It is yet another object of the present invention to provide a new and novel passive sway arrest system for dockside cargo container handling cranes which utilize a trolley that moves along a boom and girder to transport a suspended load and automatically dampens large amplitude residual sway in a suspended load after the load carrying trolley has decelerated to a stop by utilizing a closed hydraulic loop to abate rotational oscillation of a rotatable sheave supporting platform.

It is still a further object of the present invention to provide a new and novel passive sway arrest system for cargo container handling cranes which abates the small amplitude residual sway in the load after the load carrying trolley has decelerated to a stop and the large amplitude residual sway has been dampened.

Other objects and advantages of the present invention will become apparent when the method and apparatus of the present invention are considered in conjunction with the accompanying drawings.

DESCRIPTION OF THE PREFERRED EMBODIMENT

Reference is made to the drawings for a description of the preferred embodiment of the present invention wherein like reference numbers represent like elements on corresponding views.

Figure 2:
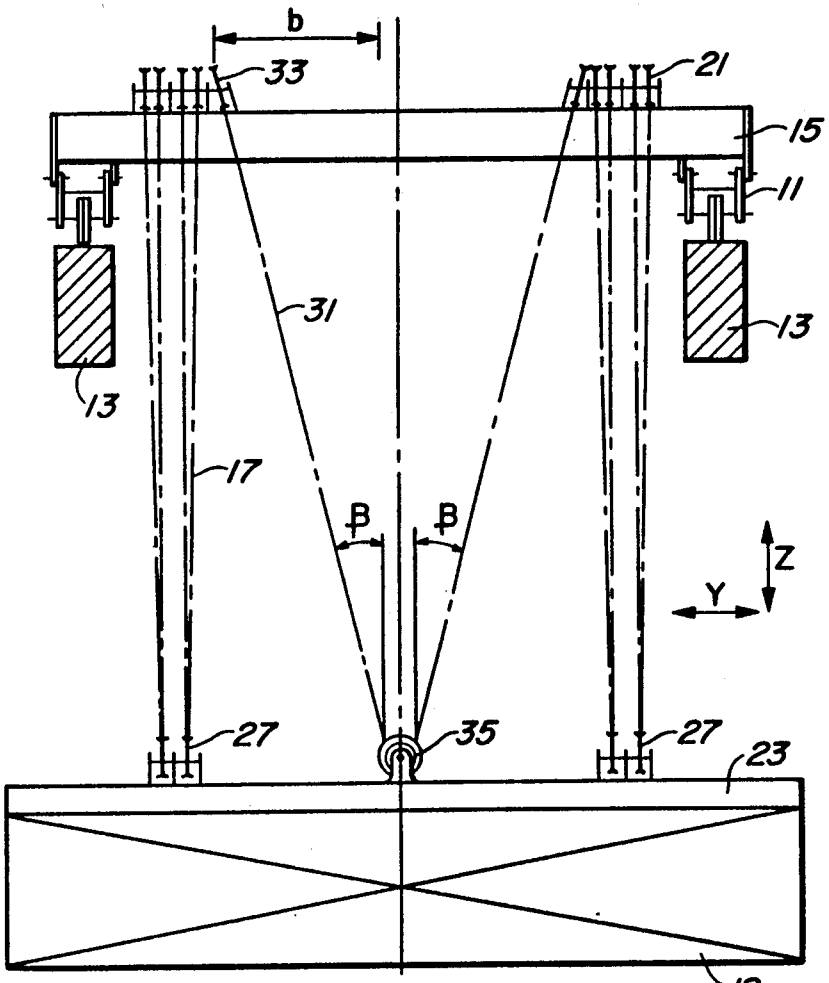
FIG. 2 is an end elevation of FIG. 1.
Figure 1:
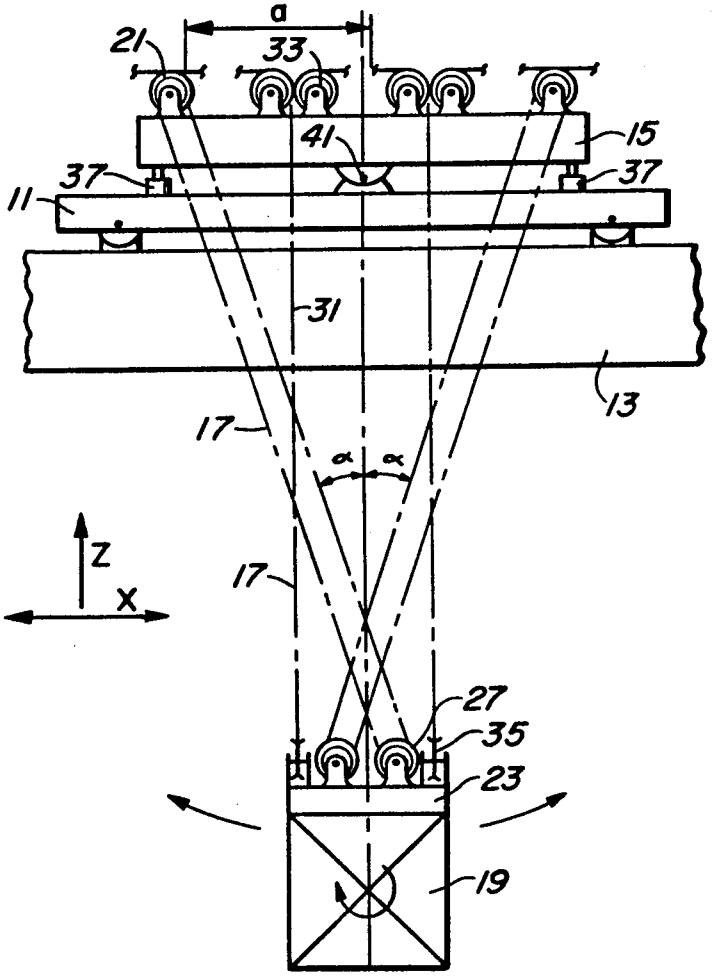
FIG. 1 is a side elevation partial schematic drawing of a load carrying trolley mounted on a partial section of a boom or girder which is supported by the gantry structure of a dockside cargo container handling crane, said FIG. 1 showing the schematic reeving thereof for supporting a cargo container lifting spreader and suspended load below the trolley

FIGS. 1 and 2 illustrate in schematic arrangement the essential characteristics of the integrated passive sway arrest system of the present invention. FIG. 1 is a representation in side elevation of a load carrying trolley 11 which moves fore and aft on the extended boom and/or the trolley girder 13 of the gantry structure of a dockside cargo container handling crane. The trolley can move between various positions including projecting outboard on the boom over a cargo deposition or pickup area, such as the hold or deck of a ship, or inboard on the trolley girder to over cargo container deposition or pickup and storage areas on the dock under or aft of the crane gantry, or off of and onto truck beds or railroad flat cars. The trolley runs on rails, which are located on the trolley girder and boom, and moves both left and right in the diagram of FIG. 1, which are fore and aft movements on the boom and trolley girder of the crane: forward movement generally being considered outboard on the cantilevered boom towards a ship or over the water, and inboard being aft on the trolley girder or towards the landside or dockside locations with respect to the crane gantry. The rails are aligned on the boom and girder whereby the trolley can transition between the two portions of the crane structure. For purposes of the description of the present invention, the term "rails" means the trolley rails mounted either on the boom or trolley girder.

The trolley 11 is provided with a pivoted or partially rotatable platform 15 which is mounted on the trolley with a journaled relation. Wire rope sheaves are mounted on the platform to guide the wire ropes 17 which are reeved through the sheaves and support the lifted load 19. The load which the invention contemplates providing sway arrest capability for is cargo containers. These are picked up by lifting spreaders which attach to the top of a container. Different length and types of lifting spreaders are utilized for different containers, and so the spreaders are engaged to the wire ropes depending from the trolley by means of a lifting spreader headblock which has wire rope sheaves mounted thereon and engages with the lifting spreader by quick disconnect locking members. As used in this description of the invention, the term "lifting spreader" includes the quick disconnect headblock whereby its sheaves are herein considered integral to the lifting spreader.

The sheaves are mounted on the trolley and the lifting spreader in a rectangular pattern, as is standard in the industry, along with additional sheaves. Essentially, the trolley and the lifting spreader need to provide a rectangular supporting structure for this purpose which is the smallest possible geometric configuration which will accomplish the purpose. However, within that configuration, part of the structure may be removed for weight saving, the passage of the wire ropes, and for other reasons. So, the trolley and the lifting spreader are described in the claims as rectangular to provide a geometric description of the support required for the sheaves and to permit a reference for their placement on the trolley and the spreader. However, in reality the trolley and the lifting spreader are not necessarily limited to a rectangular configuration.

The axis of rotation on which the rotatable sheave support platform 15 is journaled is disposed perpendicular to the fore and aft directions of motion of the trolley on the rails of the crane and horizontal to the ground. The wire ropes are actuated by motor-driven wire rope drums mounted in the machinery house on the crane gantry and fleet through the sheaves 21 on the platform as the trolley moves along the rails.

FIG. 2 is an end elevation of the trolley 11 and a suspended load 19 as viewed from one end or the other of the boom 13 and girder, from shoreside or waterside. While the major sway induced in the load is longitudinal and occurs as a result of the acceleration and deceleration of the trolley when it moves along the rails of the crane, from the load pickup location to its deposition position, certain side loads can be induced in the load by wind, unbalanced loads, and other uncontrolled forces, causing lateral sway in the suspended load. Therefore, the sway arrest system needs to incorporate a supplemental load sway arrest means which also inhibits or provides a means for arresting the lateral sway as well as the longitudinal sway which is induced into the suspended load by the trolley movement along the rails. This additional sway arrest provision also is achieved by manipulating the wire ropes 17 which are used to support the load.

Figure 3:
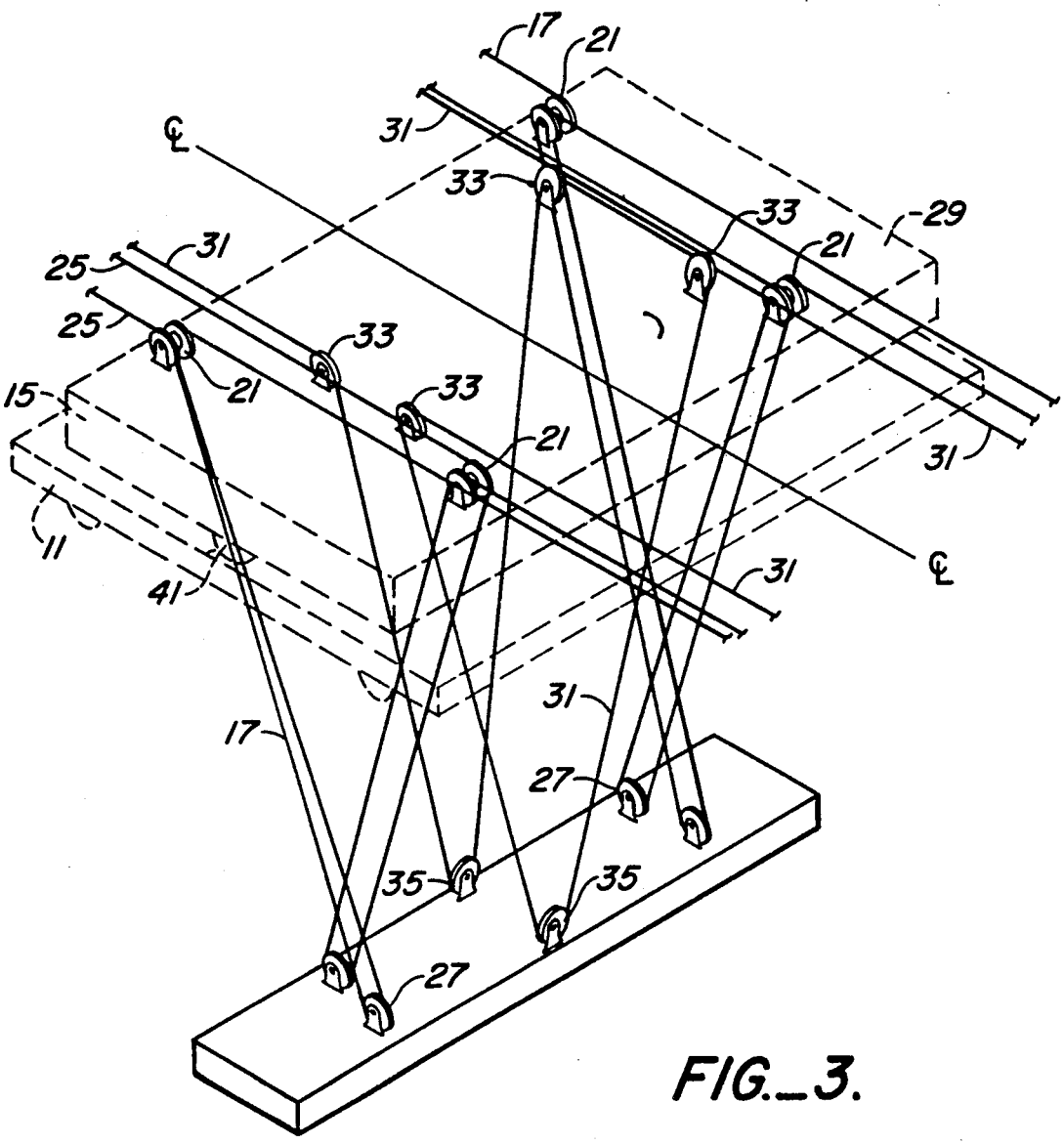
FIG. 3 is a perspective view of a partial schematic showing the wire rope reeving for supporting a cargo container lifting spreader from a load carrying trolley disposed on the boom or girder of a dockside cargo container handling crane, said trolley having a partially rotatable or pivotable sheave supporting platform journaled thereto.

The wire rope reeving utilized and employed by the present invention is illustrated in FIG. 3 of the drawings. There shown is a schematic representation of the hoist and suspension wire rope 17 used to support the load 19. The left hand side of FIG. 3 represents the inboard end of the trolley, and the right hand side of FIG. 3 is the outboard end. The inboard end of the trolley rails is the trolley girder where the machinery house and wire rope hoist drums, which take up or let out the wire rope for hoisting and lowering the load, are located. The outboard end of the trolley rails are on the boom where the wire rope reeving runs around equalizer sheaves or is dead-ended at the end of the boom as required for the purpose of operating the reeving. The wire support ropes fleet through the sheaves 21 on the trolley and the lifting spreader 23 when the trolley moves along the rails.

The two ropes 25 shown in the foreground of FIG. 3 run from the wire rope drums and pass over and down from the wire rope sheaves 21 mounted on the sheave platform of the trolley 11 which traverses the rails to move the load 19. The sheaves 21 are disposed at the effective corners of the sheave platform 15 mounted on the load carrying trolley. However, as the wire ropes traverse down to the lower sheaves 27 on the lifting spreader, they are cross reeved so that opposite corners of the sheave platform 15 on the trolley support opposite corners of the load. The same reeving occurs at the other side 29 of the sheave platform which is the lateral end thereof as well as at the other end of the lifting spreader 23: the wire support ropes are also cross reeved there to likewise support opposite corners of the load. The effective corners of the load carrying trolley and the lifting spreader are located where the load support wire rope sheaves 21 are disposed on the sheave platform and on the spreader. This cross-reeving is part of the means which eliminates the problems inherent in the prior art of the partially rotatable sheave support platform.

The middle support ropes 31 run to wire rope sheaves 33 which are disposed at separated precisely located positions on the sheave platform 15. The ropes angle downward to sheaves 35 disposed at the middle of the lifting spreader 2 and back upwards to the platform so that the ropes are angled a precise amount in their descent from the sheave platform to the lifting spreader and in their return. These angled supporting ropes inhibit and arrest lateral sway in the load when a brake is applied to the sheaves 35 disposed in the middle of the lifting spreader. In a preferred embodiment, the brake is electric and its action is intermittent: it is active when the ropes are not running through the sheaves to lift and lower the load or when the trolley moves along the rails. Conversely, it is turned off and inactivated when power is supplied to the motors for the hoist and trolley rope drums, and its operation can therefore be automatic.

The positioning of the wire rope sheaves 33, 35 for the middle support ropes is critical to the invention in order to eliminate the need for rope length compensation during raising and lowering of the load 19. As viewed in FIG. 1, distance "a," which is the horizontal distance from the contact of the wire rope with the corner mounted sheaves 21 on the sheave platform to the corner mounted sheaves 27 on the lifting spreader 23, is equal to distance "b" as viewed in FIG. 2 which is the horizontal distance from the contact of the wire rope 31 with the center mounted sheaves 33 on the platform to the contact of the wire rope with the center mounted sheaves 35 on the lifting spreader 23. This arrangement of the sheaves also ensures that the angulation of the wire ropes is constantly equal: angle $\alpha$ equals angle $\beta$ as shown in FIGS. 1 and 2, respectively.

The wire rope 17 shown in FIG. 1 is arranged to arrest sway in the X-Z plane, and the wire rope arrangement is most effective when angle $\alpha$ is the greatest. The wire rope between the platform 15 and the lifting spreader 23 is crossed in order to obtain the largest possible angle $\alpha$ at all conditions of operation and thereby serves two purposes. When the wire ropes are crossed, the load cannot swing with the ropes in a parallogram pattern as with standard straight hanging wire ropes and the wire crossing allows the largest angulation of the ropes for the greatest arresting force.

The distance between the corner sheaves 21 on the platform 15 in the fore and aft directions is limited by the dimensions of the coaming of the ship's hold and the size and depth of the cells into which the cargo containers are lowered for transport or raised for removal. Since angle $\beta$ is also limited to the same number of degrees as angle $\alpha$, the spacing between the sheaves 33 on the platform which guide the wire ropes to the center sheaves 35 on the lifting spreader is dictated by the angulation necessary in the ropes to achieve angle $\beta$. Sway arrest in the Y-Z plane of FIG. 2 (in the Y direction) is affected only by the angled reeving. This lateral sway is considerably less than that which occurs in the X-Z plane due to the acceleration and deceleration of the load when it is moved in the fore and aft X direction. There is no induced sway of the load in the lateral direction due to the fore and aft movement of the load. It only results from extraneous forces and conditions as described earlier.

Figure 8:
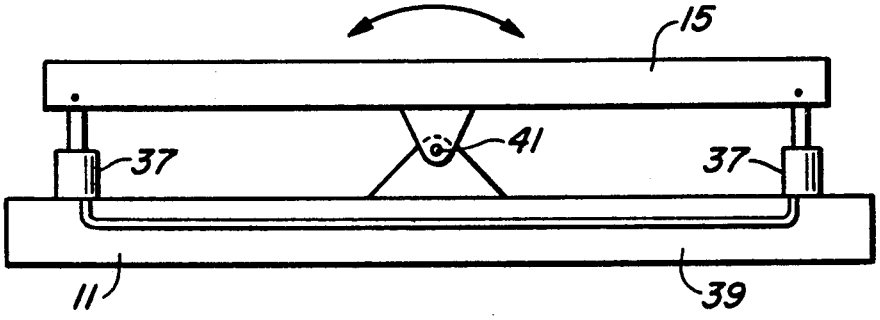
FIG. 8 is a schematic representation of a closed loop hydraulic sway dampening system.

In the preferred embodiment of the invention, the sway arrest action is accomplished by two separate braking systems which are integrated to achieve the resulting abatement effect of large and small amplitudes of sway. Reference is made to FIG. 8 which illustrates a schematic large residual sway dampening system for arresting sway. Hydraulic cylinders 37 similar to shock absorbers are disposed at opposite ends of the trolley 11 and are interposed between the sheave platform 15 and the trolley frame 11. They utilize a closed hydraulic loop 39 between them to provide resistance to the oscillation of the sheave platform on its pivot axis 41. The flow of the fluid back and forth between the cylinders occurs through a restricted orifice whereby dampening is effected until only a small residual amplitude of sway remains at which point the hydraulic fluid can flow from cylinder to cylinder essentially without impedance. At that point, small amplitude sway arrest occurs by a brake (not shown) being applied to the rotational motion of the pivot shaft 41 which is secured to the sheave support platform.

The hydraulic cylinders 37 could be utilized to arrest the small amplitude residual sway if an active system were employed wherein the flow of fluid between the cylinders was regulated by a sensor to continuously restrict the flow of fluid as the oscillation of the platform 15 abated. This would require expensive instrumentation and more fluid flow control apparatus than the preferred embodiment on/off interlock whereby the brake is activated when the hydraulic pressure in the pressurized side of the closed loop system drops below a preselected value.

The pivot shaft 41 of the rotatable platform 15 is fixed to rotate with it and oscillates in a bearing supported by the load carrying trolley frame 11 and has a portion to which a brake can be clamped therearound. The brake can be electrically actuated whereby it is turned off to save wear when the large amplitude of sway occurs and switched on, when the pressures in the hydraulic circuit subside, during small amplitude residual sway to resist residual rotational motion in the pivot shaft.

Reference is made to FIGS. 4–7 which relate to the sway arrest system for dockside cargo container handling cranes of the present invention which counteracts sway in the load after the load carrying trolley has decelerated to a stop. First, the large amplitude residual sway is dampened by the hydraulic cylinders which resist rotation of the partially rotatable sheave platform, and second, the remaining small amplitude residual sway abatement is effected by braking the rotational oscillation of the sheave platform by means of the electrically activated brake on the pivot shafts.

Figures 4, 5, 6, 7:
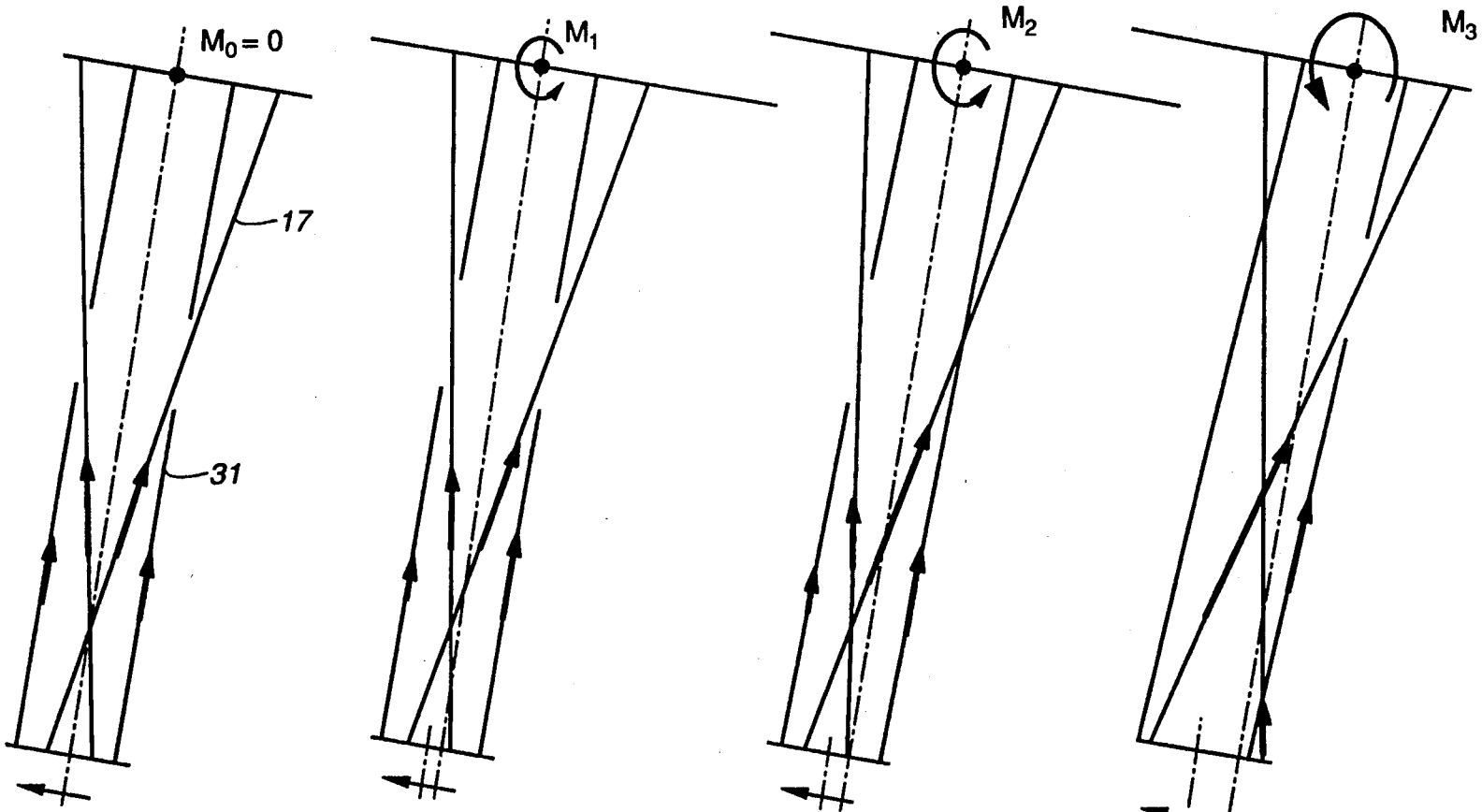
FIGS. 4–7 are partial side elevation force diagrams showing the relative forces which act upon the wire rope reeving supporting the swaying cargo container load when a brake is applied to the rotational motion of the sheave supporting platform which carries the wire rope sheaves on the load carrying trolley for supporting the load.

FIG. 4 shows a no-braking moment $M_0$ single plane pendulum situation, which by virtue of the arrangement of the crossed supporting ropes, keeps the load geometrically suspended directly underneath the sheave platform. The loads in the ropes are partially balanced as illustrated by the arrows with the crossed ropes carrying greater loads by virtue of their angulation while the parallel ropes share the load.

FIG. 5 illustrates the change in loading on the wire rope reeving of FIG. 4 when a braking moment $M_1$ is applied to the rotational axis of the sheave platform. The braking moment is applied either by the hydraulic cylinders resisting movement of the platform or by the brake on the pivot shaft of the platform applying a torque to the shaft to counteract its rotation. In both FIGS. 4 and 5, the load is swaying clockwise to the left, while the applied braking torque is counterclockwise and counter to the swinging motion of the load. This changes the forces in the support ropes and provides greater forces in the ropes which tend to pull the load back in the opposite direction from its direction of sway.

FIG. 6 shows that the rope forces imposed by the moment $M_2$ can be increased to a substantial imbalance, within an allowable limit, which dampens the sway. FIG. 7 illustrates that the braking force can be increased until the geometric balance limit is achieved at which point zero force occurs in the two support ropes sheaved at the left side of the sheave platform. A braking force in excess of the geometric balance limit will cause the unrestrained wire ropes to go slack which is generally considered an unacceptable condition because it puts all of the load on just one-half of the support ropes and is a practical impossibility because the weight of the load is too great to allow a slack condition to occur. In practice, the simplest embodiment of the invention utilizes a preselected continuous braking force which is activated after the large amplitude residual sway has been abated by the hydraulic cylinders.

In operation, the hydraulic sway dampening system comes into action to arrest the large amplitude residual sway after the load has decelerated to a stop. As that is being cancelled out, the small amplitude sway arrest system comes into operation to arrest the residual sway by applying a brake to the pivot shaft that supports the sheave platform.

Thus, it will be apparent from the foregoing description of the invention, in its preferred form, that it will fulfill all the objects and advantages attributable thereto. While it is illustrated and described in considerable detail herein, the invention is not to be limited to such details as have been set forth except as may been necessitated by the appended claims.

I claim:

1. A passive sway arrest system for a dockside cargo container handling crane having a load carrying generally rectangular trolley which moves fore and aft on rails which are mounted on a girder and extended boom of the crane with a generally rectangular cargo container lifting spreader suspended beneath the trolley by wire rope reeving, said system comprising sheaves mounted on said trolley and said lifting spreader to support said load by the wire rope reeving depending from said trolley, said sheaves on said trolley and said spreader being effective proximate to the corners of the fore and aft ends of said trolley and to the corners of the spreader, the wire ropes of said reeving being cross reeved in the fore and aft direction along the rails to opposite corners of the trolley and the spreader at both ends of the spreader, and means for arresting sway in a direction perpendicular to the fore and aft direction of motion of the trolley along the rails of the crane, including pairs of sheaves disposed on said trolley proximate the lateral ends thereof, and a pair of sheaves supporting said lifting spreader proximate the middle thereof on opposite sides thereof, said reeving including wire ropes which are angled from the spaced-apart pairs of sheaves on said trolley through the pairs of sheaves supporting the load at the middle thereof to arrest sway perpendicular to the direction of trolley travel, the horizontal distance from the contact of the wire rope with the lateral end mounted sheaves on the trolley to the contact with the lifting spreader middle mounted sheaves being equal to the horizontal distance from the contact of the wire rope with corner mounted sheaves on the trolley to the spreader corner mounted sheaves, the angulation of the ropes which run from the trolley to the middle mounted sheaves disposed at the center of the lifting spreader being equal to the angulation of the ropes which are cross-reeved.

2. The passive sway arrest system of claim 1 including a partially rotatable platform mounted on the trolley for supporting the wire rope sheaves through which the wire rope reeving is reeved to support the lifting spreader, said platform being mounted to said trolley with a journaled relation having a horizontal axis of rotation disposed perpendicular to the fore and aft direction of motion of the trolley along the rails of the crane, and means for arresting residual sway in the load by dampening the oscillation of the rotatable platform caused by the sway of the load, said means including a closed loop hydraulic system that counteracts the rotational oscillating motion of said rotatable platform.

* * * * *